US008100029B2

(12) United States Patent
Peterson et al.

(10) Patent No.: US 8,100,029 B2
(45) Date of Patent: Jan. 24, 2012

(54) CONTROL INCEPTOR SYSTEMS AND ASSOCIATED METHODS

(75) Inventors: Terry Peterson, Eagle Rock, CA (US); Kevin Allen, Canyon Country, CA (US)

(73) Assignee: Mason Electric Co., Sylmar, CA (US)

( * ) Notice: Subject to any disclaimer, the term of this patent is extended or adjusted under 35 U.S.C. 154(b) by 1018 days.

(21) Appl. No.: 12/029,435

(22) Filed: Feb. 11, 2008

(65) Prior Publication Data

US 2008/0190233 A1 Aug. 14, 2008

Related U.S. Application Data

(60) Provisional application No. 60/901,040, filed on Feb. 12, 2007.

(51) Int. Cl.
*G05G 9/047* (2006.01)

(52) U.S. Cl. ..... 74/471 XY; 244/234

(58) Field of Classification Search ..... 244/158.1, 244/234, 220, 221, 223; 74/471 XY
See application file for complete search history.

(56) References Cited

U.S. PATENT DOCUMENTS 3,011,739 A * 12/1961 Boyce et al. ..... 244/237
3,028,126 A * 4/1962 Holleman ..... 244/236
4,012,014 A * 3/1977 Marshall ..... 244/234
4,947,701 A * 8/1990 Hegg ..... 74/471 XY
4,962,448 A * 10/1990 DeMaio et al. ..... 700/17
5,142,931 A * 9/1992 Menahem ..... 74/471 XY

* cited by examiner

*Primary Examiner* — Timothy D Collins
*Assistant Examiner* — Michael A Fabula
(74) *Attorney, Agent, or Firm* — Perkins Coie LLP

(57) ABSTRACT

Control inceptor systems and associated methods, including inceptors suitable for high-g operations and/or inceptors having a center of rotation located within an operator's grasp region, are disclosed herein. One aspect of the invention is directed toward a control inceptor having a grip coupled to a support. The inceptor is configured so that a center of rotation for movement in at least one plane is located within the grasp region of an operator when an operator grasps the grip. The support is positioned so that when the operator moves the grip (e.g., makes an input movement), the support arcs about the center of rotation.

33 Claims, 5 Drawing Sheets

CONTROL INCEPTOR SYSTEMS AND ASSOCIATED METHODS

CROSS-REFERENCE TO RELATED APPLICATIONS

This application claims priority to U.S. Patent Application No. 60/901,040 filed Feb. 12, 2007, entitled CONTROL INCEPTOR SYSTEMS AND ASSOCIATED METHODS, which is incorporated herein by reference in its entirety.

TECHNICAL FIELD

Embodiments of the present invention relate to control inceptor systems and associated methods, including inceptors suitable for high-g operations and/or inceptors having a center of rotation located within an operator's grasp region.

BACKGROUND

Conventional control inceptors for aircraft and other vehicles include wheels, yokes, and control sticks. These inceptors typically allow the operator to make inputs in two axes. For example, a typical aircraft control stick is moved in a plane fore and aft to command aircraft pitch. Similarly, the control stick is moved in a plane side to side to command roll. The stick typically includes a grip that the pilot grasps when making input commands or control inputs. The stick is generally pivotally coupled to the aircraft at one or more pivot point(s) below the grip. For example, the stick can include a pivot point for pitch inputs and another pivot point for roll inputs. Therefore, as the pilot makes control inputs, the pilot typically moves his or her entire hand in the desired direction of the input. Because the pivot point(s) are located below the grip, the grip and the pilots hand arc about the pivot point(s) as the control inputs are made.

During high and/or varying g operations, it can be difficult to make precise inputs using current or typical control inceptors because the high and/or varying g environment exerts force(s) on the pilot's hand. Because the pilot's hand must arc around the pivot point(s) to make control inputs, this/these force(s) on the pilot's hand can make it difficult for the pilot to make precise control inputs. For example, as the pilot's hand arcs about the pivot point(s), the pilot must continually adjust the direction of force he or she is applying to compensate for the g force(s). Additionally, this/these force(s) can cause the pilot's hand to arc about the pivot point(s), when the pilot does not desire to make a control input.

SUMMARY

Embodiments of the present invention overcome drawbacks experienced in the prior art and provide other benefits. One embodiment provides a control inceptor system comprising a grip configured to be grasped by an operator's hand and located within a grip region of the hand. A first movement mechanism is coupled to the grip and rotatable with the grip in a first plane about a first center of rotation that is positioned within the grip region when the operator is grasping the grip. A second movement mechanism coupled to the grip and rotatable with the grip in a second plane about a second center of rotation that is positioned within the grip region when the operator is grasping the grip, wherein the second plane is angularly offset from the first plane.

Another embodiment provides a control inceptor system comprising a grip configured to be grasped by the operator's hand wherein the grip is within the grip region. The grip is moveable in a three-dimensional X-Y-Z frame of reference defined by an XY plane, a YZ plane and a ZX plane all orthogonal to each other. A first movement mechanism is coupled to the grip, and at least a portion of the first movement mechanism is rotatable with the grip in the XY plane about a first center of rotation that is positioned within the grip region when the operator is grasping the grip and applying a first input force to the grip substantially parallel to the XY plane. A second movement mechanism is coupled to the grip, and at least a portion of the second movement is rotatable with the grip in the YZ plane about a second center of rotation that is positioned within the grip region when the operator is grasping the grip and applying a second input force to the grip substantially parallel to the YZ plane.

Another embodiment provides a control system for a vehicle comprising control devices moveable to provide control of at least a portion of the vehicle, a control area configured to receive the operator therein, and a control inceptor system mounted in the control area and coupled to the control devices. The control inceptor system comprises a grip configured to be grasped by the operator's hand and located within the grip region of the hand. A first movement mechanism is coupled to the grip and is rotatable with the grip in a first plane about a first center of rotation that is positioned within the grip region when the operator is grasping the grip. A second movement mechanism is coupled to the grip and is rotatable with the grip in a second plane about a second center of rotation that is positioned within the grip region when the operator is grasping the grip, wherein the second plane is angularly offset from the first plane.

DETAILED DESCRIPTION

Figure 1:
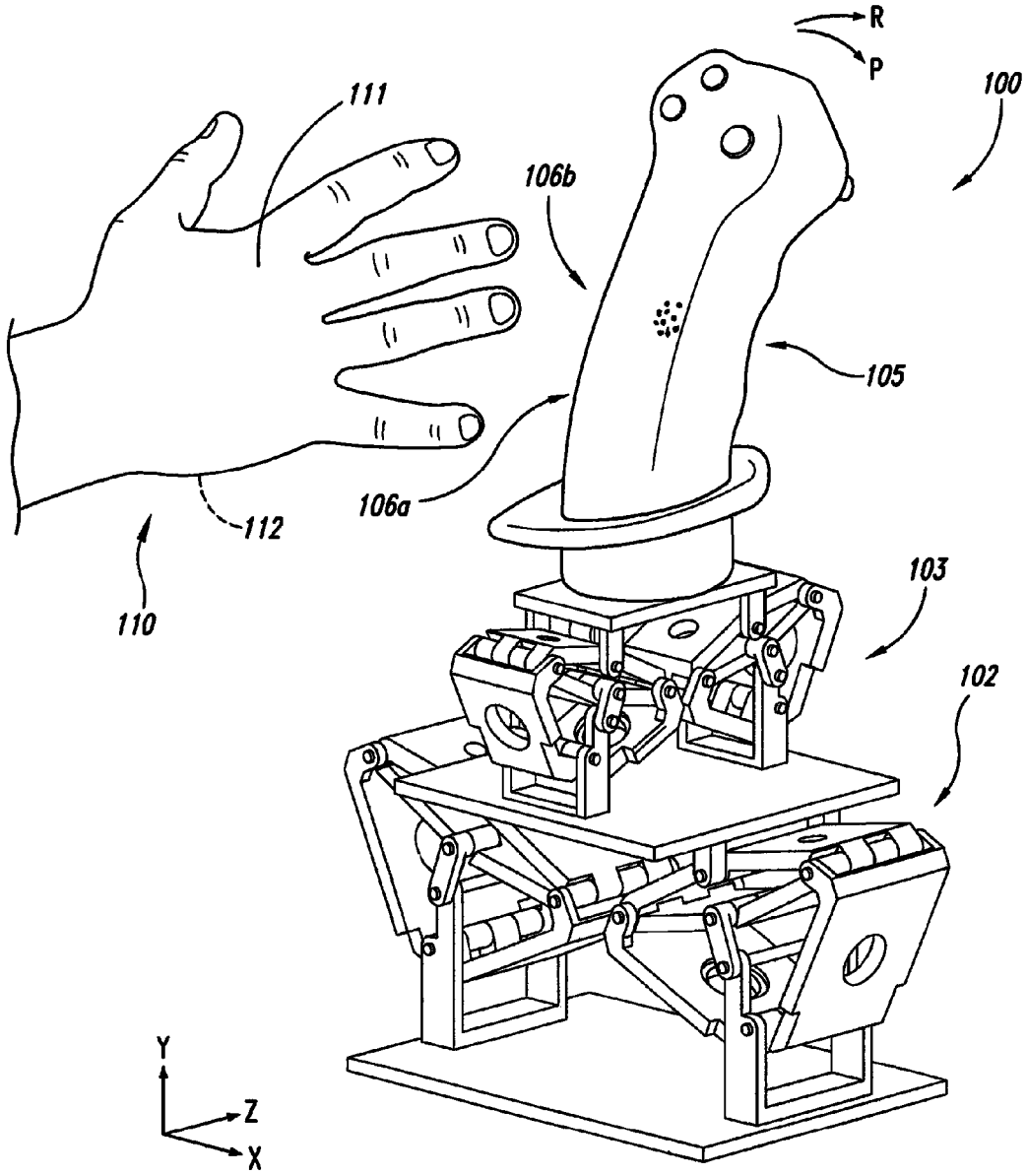
FIG. 1 is an isometric illustration of a portion of a control inceptor system in accordance with embodiments of the invention.

The present invention is directed generally toward control inceptor systems and associated methods, including inceptors suitable for high-g operations and/or inceptors having a center of rotation located within an operator's grasp region. One aspect of the invention is directed toward a control inceptor system having a center of rotation for receiving input movements located within the operator's grasp region when an operator is grasping a grip of the inceptor. In selected embodiments, the center of rotation includes the center of rotation for input movements about an axis that is at least approximately parallel to a line extending between the back of the operator's hand and the palm of the operator (e.g., a pitch input in a conventional aircraft). In certain embodiments, this movement can include movement in a plane that is at least approximately parallel to the width and length of the operator's palm as the operator's hand grasps the grip.

One skilled in the art will recognize that based on ergonomics, the grip of the inceptor may be tilted or shaped so that the actual axis of rotation is not exactly parallel with the line extending between the back of the operator's hand and the palm of the operator's hand, but because this axis and line are at least approximately parallel, the operator will perceive that the operator is making an input movement having a similar axis of rotation and/or a movement that indicates a similar input command as if the axis of rotation and line were parallel. Similarly, an input movement in a plane that is at least approximately parallel to the width and length of the operator's palm as the operator's hand grasps the grip includes movements that an operator would perceive to be in a similar plane and/or a movement that indicates a similar input command as if the plane and the width and length of the operator's palm were parallel.

Additionally, one skilled in the art will recognize that the center of rotation being located within the operator's grasp region can include the center of rotation being located in or on a portion of the grip configured to be grasped by the operator or configured to be at least partially surrounded by one or more portions of the operator's hand. Additionally, in certain embodiments the center of rotation being located within the operator's grasp region can include the center of rotation being located at least approximately between spaced apart portions of the operator's hand as the operator grasps the grip. Furthermore, in selected embodiments the center of rotation being located within the operator's grasp region can also include the center of rotation being located anywhere on or within the operator's hand when the operator's hand grasps the grip. In still other embodiments where the operators hand only partially surrounds the grip, the center of rotation being located within the operator's grasp region can include the center of rotation being located within a curvilinear area or space extending around the grip where the operator's hand does not extend as the operator grasps the grip. For example, in certain embodiments this curvilinear space can extend around the outside of the grip between a portion of the operator's fingers and thumb and can have at least approximately the same thickness as the thickness of the operator's hand (e.g., the distance between the back of the operator's hand and the operator's palm).

In other embodiments, the center of rotation includes the center of rotation for input movements about an axis that is at least approximately parallel to the longitudinal axis of the operator's forearm as the operator grasps the grip (e.g., a roll input in a conventional aircraft). In certain embodiments, this can include movement in a plane that is at least approximately parallel to the length and thickness of the operator's palm as the operator's hand grasps the grip. Of course, one skilled in the art will recognize that based on ergonomics, the grip of the inceptor may be tilted or shaped so that the actual axis of rotation is not exactly parallel with the longitudinal axis of the operator's forearm, but because the axis of rotation and the longitudinal axis of the operator's forearm are at least approximately parallel, the operator will perceive that the operator is making an input movement having a similar axis of rotation and/or a movement that indicates a similar input command as if the axis of rotation and the longitudinal axis of the operator's forearm were parallel. Similarly, an input movement in a plane that is at least approximately parallel to the length and thickness of the operator's palm as the operator's hand grasps the grip includes movements that an operator would perceive to be in a similar plane and/or a movement that indicates a similar input command as if the plane and the length and thickness of the operator's palm were parallel.

Still other aspects of the invention are directed toward a control inceptor system having a first center of rotation for receiving input movements in a first plane and a second center of rotation for receiving input movements in a second plane. The control inceptor system can include a grip. The first and second centers of rotation can be located within the operator's grasp region when an operator is grasping the grip of the inceptor.

Yet other aspects of the invention are directed toward a control inceptor having a grip coupled to a support. The inceptor is configured so that a center of rotation for movement in at least one plane is located within the grasp region of an operator when an operator grasps the grip. The support is positioned so that when the operator moves the grip (e.g., makes an input movement) the support arcs about the center of rotation.

Still other aspects of the invention can include a control inceptor system that includes a grip coupled to a first support. The system further includes a first saddle coupled to the first support. The system still further includes a second saddle coupled to a second support. The system yet further includes a drive link, one or more translational members, and multiple linkage members coupled between the first and second saddles. In selected embodiments, the system includes a sensor for sensing the position of at least one of the drive links, the translational members, and the linkage members.

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail, so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this Detailed Description section.

Furthermore, unless the context clearly requires otherwise, throughout the description and the claims, the words "comprise," "comprising," and the like are to be construed in an inclusive sense as opposed to an exclusive or exhaustive sense, i.e., in a sense of "including, but not limited to." Additionally, the words "herein," "above," "below," and words of similar import, when used in this application, shall refer to this application as a whole and not to any particular portions of this application. Use of the word "or" in reference to a list of items is intended to cover a) any of the items in the list, b) all of the items in the list, and c) any combination of the items in the list. As used herein, the term "center of rotation" includes a point in a plane that remains unchanged under a rotation of the plane. Accordingly, the axis of rotation of the plane runs through the center of rotation and is perpendicular to the plane. For example, a center of rotation for receiving input movements includes a point about which the input movement or rotation is made in the selected plane. It will be recognized by one skilled in the art that in selected embodiments, an inceptor can be configured to simultaneously receive multiple input movements in multiple planes.

FIG. 1 is an isometric illustration of a portion of a control inceptor system 100 in accordance with embodiments of the invention, In FIG. 1, the control inceptor system 100 includes a grip 105, a first movement mechanism 102, and a second movement mechanism 103. A portion of the grip 105 is configured to be grasped by an operator's hand 110, which has a back side 111 and a palm side 112. In the illustrated embodiment, the control inceptor system 100 is configured to be a control inceptor on an aerospace vehicle. In other embodiments, the control inceptor system 100 can be configured as a control inceptor for other uses, including on other types of vehicles and/or for non-vehicular use. In FIG. 1, the sensitivity of grip inputs to system outputs can be a function of the size and relative location of various portions of the first and second movement mechanisms 102 and 103.

In the illustrated embodiment, the inceptor is configured to receive input movement in the XY plane and in the YZ plane. For example, input movement in the XY plane and in the YZ plane can include a rotational movement in the XY plane and in the YZ plane. In FIG. 1, the first center of rotation 106a for movement in the XY plane and the second center of rotation 106*b* for movement in the YZ plane are collocated in the interior of the portion of the grip 105 that is configured to be grasped by the operator's hand 110. Accordingly, the center of rotations 106*a* and 106*b* are within the operator's grasp region when the operator grasps the grip 105. For example, in certain embodiments the operator's hand 110 rotates about at least one of the center of rotations 106*a* and 106*b* as the operator makes selected control inputs using the control inceptor system 100.

In other embodiments, the centers of rotation 106*a* and 106*b* are not collocated, but are both located within the operator's grasp region when the operator grasps the grip 105. As discussed above, the center of rotation being located within the operator's grasp region can include the center of rotation being located anywhere on or within the operator's hand when the operator's hand grasps the grip. For example, in certain embodiments at least one of the centers of rotation 106*a* and 106*b* can be located slightly off the grip so that it corresponds to the surface of the operators hand or a point in space corresponding to a location inside the operator's hand when the operator's hand grasps the grip. For instance, based on the tilt and/or shape of the grip a center of rotation can be located within the operator's hand between the back side and the palm when the operator is grasping the grip. Additionally, as discussed above, in still other embodiments where the operators hand only partially surrounds the grip, the center of rotation being located within the operator's grasp region can include being located within a curvilinear area or space extending around the grip where the operator's hand does not extend as the operator grasps the grip.

In FIG. 1, input movements in the XY plane are made by rotating the grip 105 about the first center of rotation 106*a* in the direction of arrow P, and/or opposite to the direction of arrow P, to provide pitch input to the aircraft/aircraft control system. As the operator's hand grasps the grip, this movement is about an axis that is at least approximately parallel to a line extending between the back of the operator's hand and the palm of the operator's hand, and is in a plane that is at least approximately parallel to the width and length of the operator's palm as the operator's hand grasps the grip. The grip 105 is coupled to the first movement mechanism 102, which is configured to allow the grip 105 to move or rotate about the first center of rotation 106*a*.

In the illustrated embodiment, input movements in the YZ plane are made by rotating the grip 105 about the second center of rotation 106*b* in the direction of arrow R, and/or opposite to the direction of arrow R and provide roll input to the aircraft/aircraft control system. As the operator's hand grasps the grip, this movement is about an axis that is at least approximately parallel to the longitudinal axis of the operator's forearm and is in a plane that is at least approximately parallel to the length and thickness of the operator's palm as the operator's hand grasps the grip. The grip 105 is coupled to the second movement mechanism 103, which is configured to allow the grip 105 to move or rotate about the second center of rotation 106*b*. In FIG. 1, the grip is connected to the second movement mechanism 103 at a connection point (and coupled to the first movement mechanism 103 is via the second movement mechanism 103) such that the first and second center of rotations 106*a* and 106*b* are spaced away from the connection point. As discussed below in further detail, in selected embodiments one or more sensors or sensing systems can be located proximate to, and/or coupled to, portions of the grip 105, first movement mechanism 102, and/or second movement mechanism 103 to determine the relative position of the grip 105 as the grip is moved.

Figure 2:
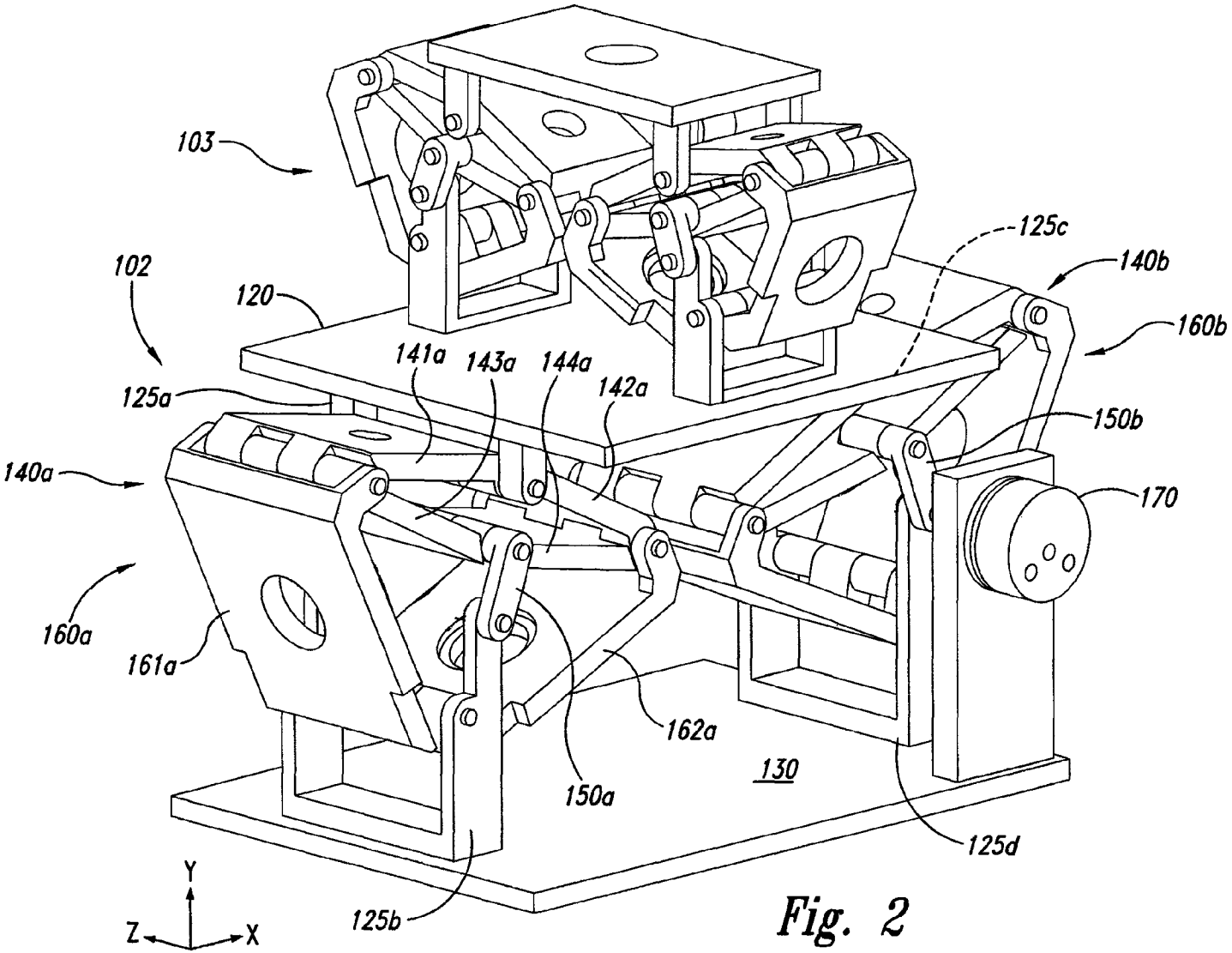
FIG. 2 is an enlarged isometric illustration of a portion of the control inceptor system shown in FIG. 1.

FIG. 2 is an enlarged isometric illustration of a portion of the control inceptor system 100 shown in FIG. 1. In FIG. 2, the first and second movement mechanisms 102 and 103 are shown without the grip 105. As discussed above, the first movement mechanism 102 allows the grip 105 to move or rotate in the first plane and the second movement mechanism 103 allows the grip 105 to move or rotate in the second plane. Accordingly, in the illustrated embodiment the first and second movement mechanisms 102 and 103 are similar in operation and are positioned so that the first and second planes are at least approximately 90 degrees from one another to provide output signals related to movement in orthogonally oriented directions, such as pitch and roll control for the aerospace vehicle. For the purpose of illustration only, the first movement mechanism 102 will be discussed in detail. However, one skilled in the art will recognize that the second movement mechanism 103 is configured and operates similar to the first movement mechanism 102 allowing the grip to move in a different plane.

In FIG. 2, the grip 105 is coupled to the first movement mechanism 102 via the second movement mechanism 103. The second movement mechanism 103 is configured to transmit forces applied to the grip 105 in the XY plane to the first movement mechanism 102, which allows the grip 105 to move or rotate in the XY plane. Similarly, when force is transmitted to the grip 105 in the YZ plane, the second movement mechanism allows the grip 105 to rotate in the YZ plane.

In the illustrated embodiment, the first movement mechanism 102 includes a first support 120 (e.g., top support plate) and a second support 130 (e.g., bottom support plate) spaced apart from each other. A first saddle 125*a* is coupled to the first support 120 and a second saddle 125*b* is coupled to the second support 130. The supports include structure that allow other elements to be pivotally attached the first and second supports 120 and 130.

In FIG. 2, the first movement mechanism 102 also includes a first expanding/collapsing structure 140*a*, a first drive link 150*a*, and a first translational structure 160*a* coupled between the first and second saddles 125*a* and 125*b*. In the illustrated embodiment, the expanding/collapsing structure 140*a* includes a trapezoidal structure with four linkage members, shown as a first linkage member 141*a*, a second linkage member 142*a*, a third linkage member 143*a*, and a fourth linkage member 144*a*. In FIG. 2, the four linkage members are pivotally coupled together to form a trapezoid that can expand (e.g., extend) and collapse (e.g., retract) in the Y direction. Additionally, the trapezoid can tilt in a manner that allows portions of the trapezoid to translate. In FIG. 2, the first and second linkage members 141*a* and 142*a* are pivotally coupled to the first saddle 125*a* and to the second and third linkage members 143*a* and 144*a*. The second and third linkage members 143*a* and 144*a* are also pivotally coupled to together. In other embodiments, the expanding/collapsing structure can have other shapes and/or other elements that allow at least a portion of the structure to expand/collapse or extend/retract in one or more directions. In FIG. 2, the first drive link 150*a* is pivotally coupled to the second and third linkage members 143*a* and 144*a* at the point that the second and third linkage members 143*a* and 144*a* are coupled to each other. Additionally, the first drive link 150*a* is pivotally coupled to the second saddle 125*b*.

In the illustrated embodiment, a first translational structure 160*a* is coupled between the second saddle 125*b* and the first expanding/collapsing structure 140. In FIG. 2, the first translational structure 160*a* includes a first translational member 161*a* and a second translation member 162*a*. The first translational member 161*a* is pivotally coupled to the second saddle 125*b* and to the first and third linkage members 141*a* and 143*a* at the point where the first and third linkage members 141*a* and 143*a* are pivotally coupled together. The second translational member 162*a* is pivotally coupled to the second saddle 125*b* and to the first and third linkage members 141*a* and 143*a* at the point where the first and third linkage members 141*a* and 143*a* are pivotally coupled together. The first translational structure 160*a* limits the motion of the trapezoidal structure as the first saddle 125*a* and the first support 120 move relative to the second saddle 125*b* and the second support 130. For example, the translating structure can limit the way the trapezoidal structure expands, collapses, tilts, and/or moves by limiting the range of motion of the linkage members, the rotation of the trapezoidal structure relative to the corresponding drive link, and the rotation of the drive link relative to the corresponding saddle.

Figure 3:
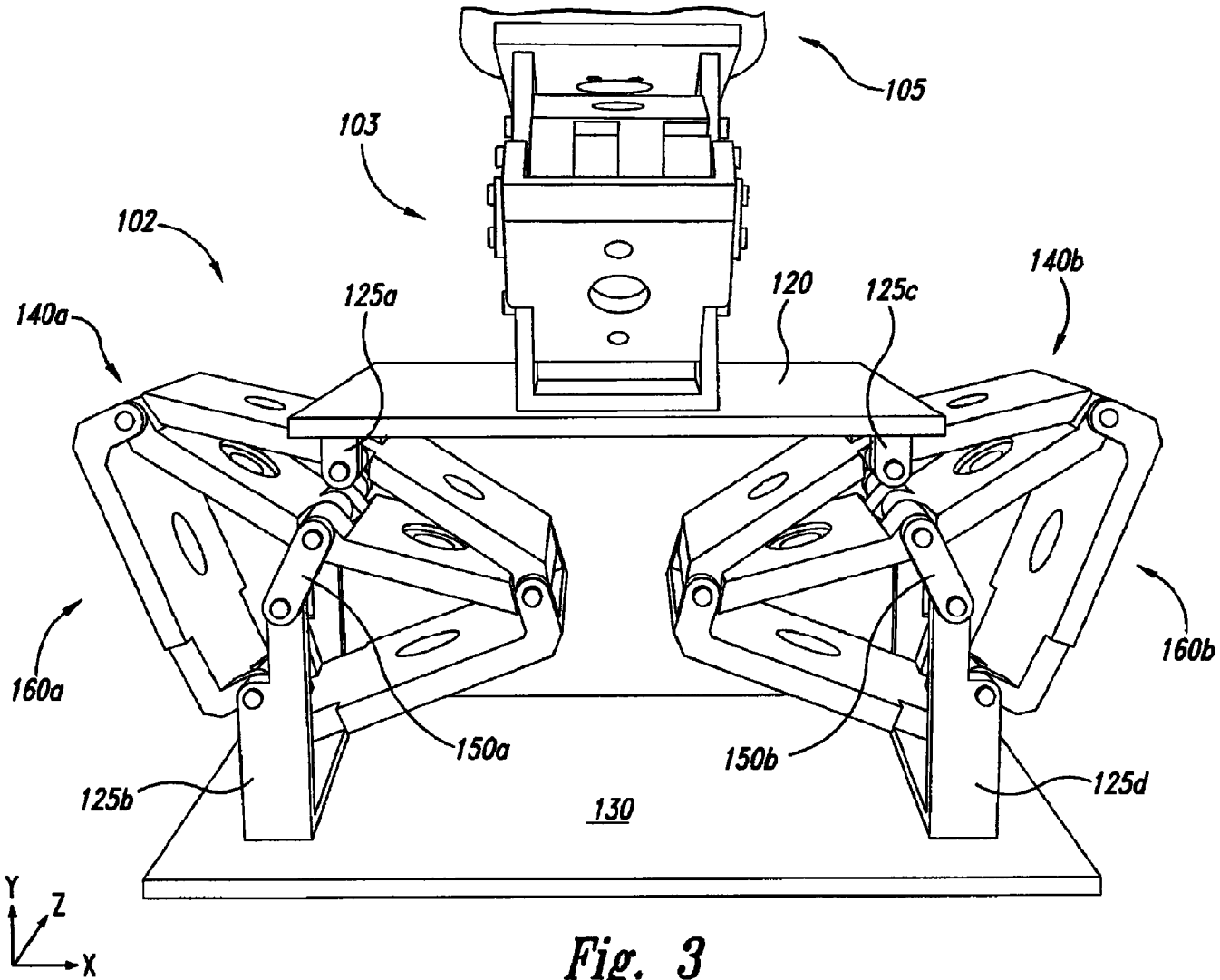
FIG. 3 is an isometric illustration of a portion of the control inceptor system shown in FIG. 1 with a movement mechanism in a neutral position.
Figure 4:
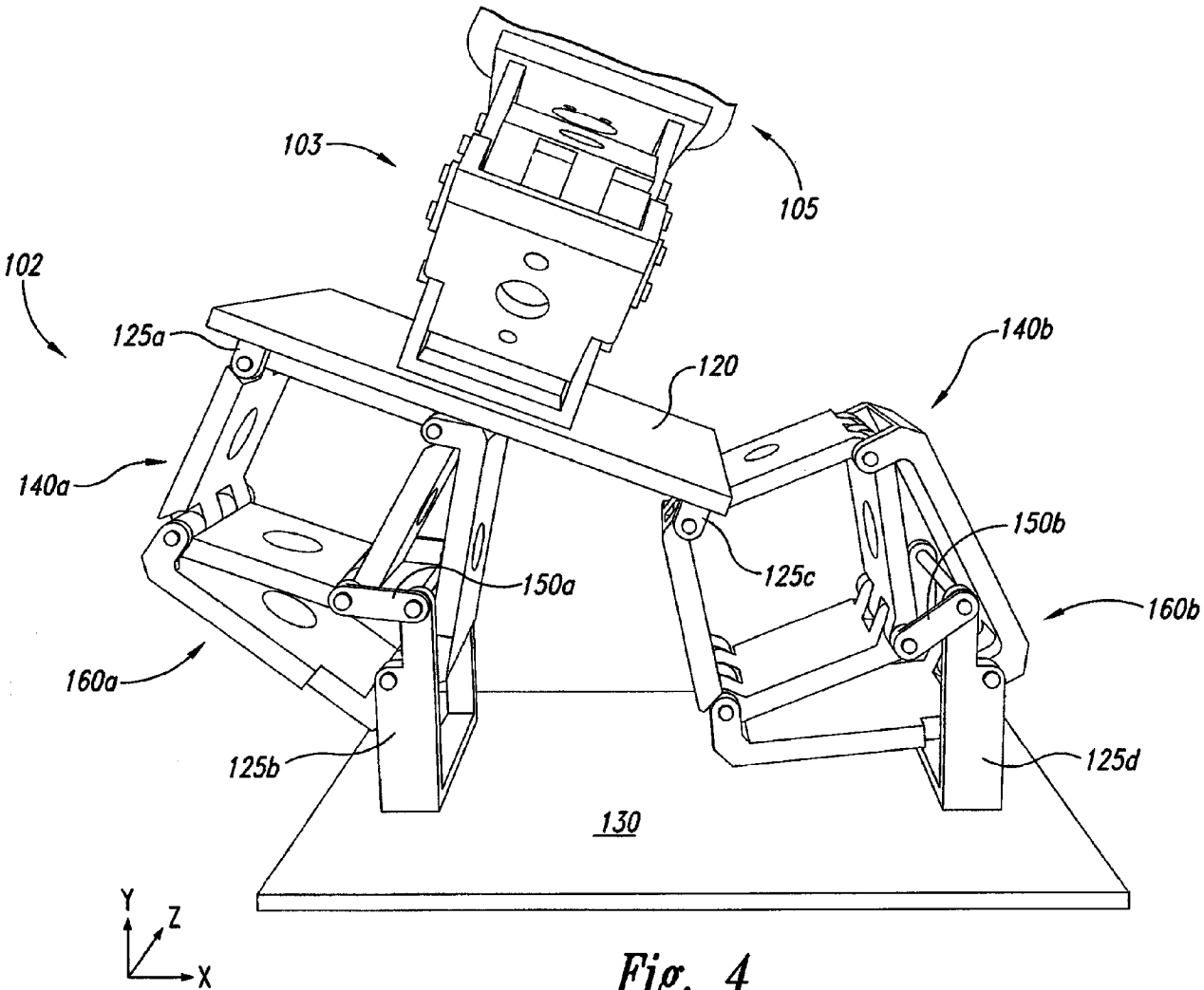
FIG. 4 is an isometric illustration of a portion of the control inceptor system shown in FIG. 3 with the movement mechanism positioned away from the neutral position in a first direction.
Figure 5:
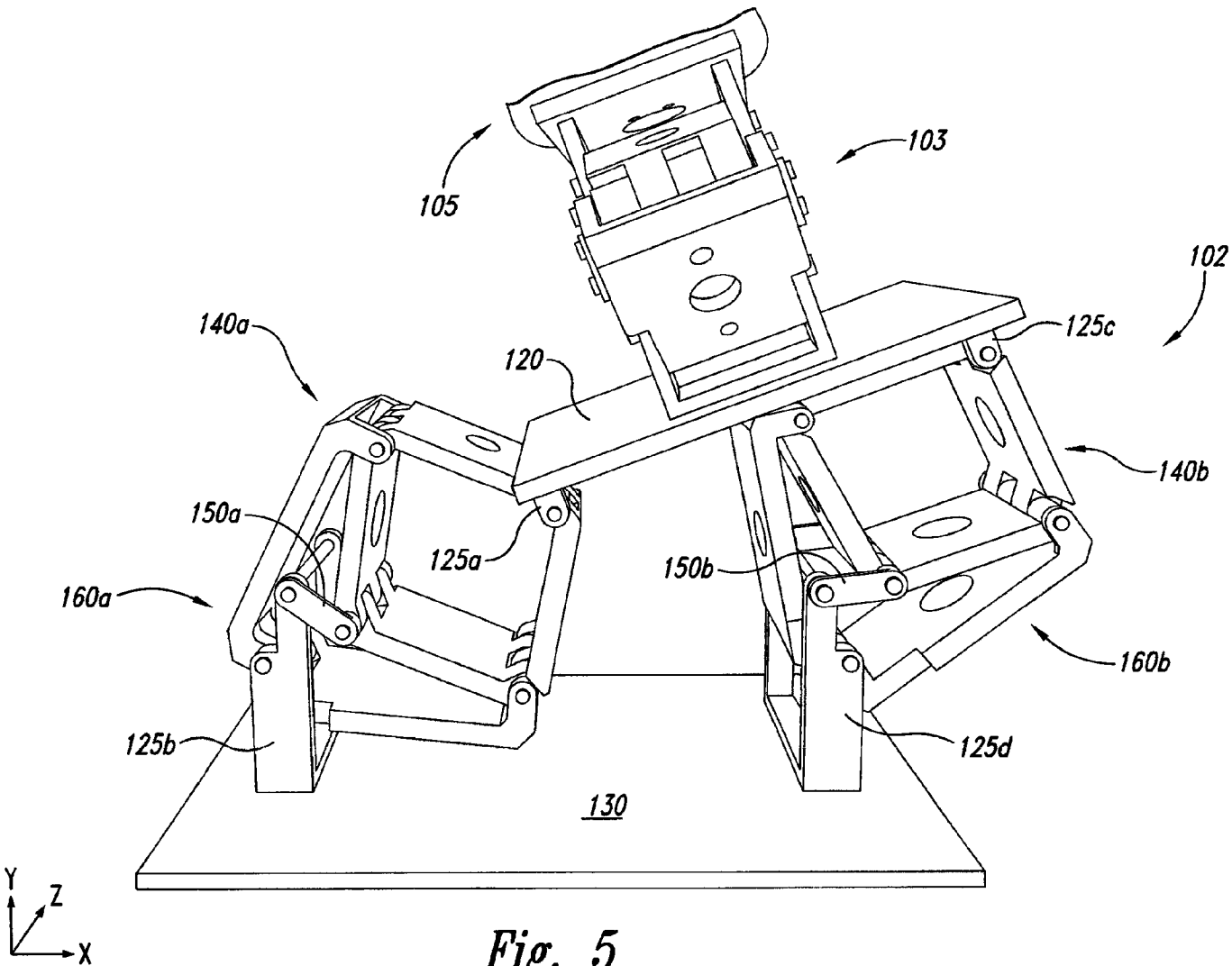
FIG. 5 is an isometric illustration of a portion of the control inceptor system shown in FIG. 3 with the movement mechanism positioned away from the neutral position in a second direction.

In the illustrated embodiment, the first support 120 is coupled to a third saddle 125*c*, which is similar to and spaced apart from the first saddle. Additionally, the second support 130 is coupled to a fourth saddle 125*d*, which is similar to and spaced apart from the second saddle. A second expanding/collapsing structure 140*b*, a second drive link 150*b*, and a second translational structure 160*b* are pivotally coupled between the third and fourth saddles 125*c* and 125*d* in a manner similar to that discussed above with reference to the first expanding/collapsing structure 140*a*, the first drive link 150*a*, and the first translational structure 160*a*. As shown in FIGS. 3-5, this arrangement of the control inceptor system 100 allows the grip 105 to rotate in the XY plane (about a center of rotation which is spaced apart from the first and second supports 120 and 130), causing the first support 120 to translate in an arc in the XY plane about the center of rotation (discussed above with reference to FIG. 1), while the second support 130 does not rotate in, or remains fixed relative to, the XY plane.

For example, FIG. 3 is an isometric illustration of a portion of the control inceptor system 100 shown in FIG. 1 with the first movement mechanism 102 and the grip 105 in a first or neutral position. In FIG. 3, the trapezoidal structure is collapsed in the Y axis and the first and second drive links 150*a* and 150*b* are in first positions relative to the second and fourth saddles 125*b* and 125*d*, respectively. FIG. 4 is an isometric illustration of a portion of the control inceptor system 100 shown in FIG. 3 with the first movement mechanism 102 and grip 105 in a second position. In FIG. 4, the grip has been rotated about the center of rotation in the XY plane away from the first position in the direction of arrow P (shown in FIG. 1), representing an aerospace vehicle nose down pitch command. Correspondingly, the first support 102 has rotated about the center of rotation and the first and second drive links 150*a* and 150*b* have moved/rotated to second positions relative to the second and fourth saddles 125*b* and 125*d*, respectively. For example, the drive links 150*a* and 150*b* have rotated in a first or counterclockwise direction (as viewed in FIG. 3) about the point where they are pivotally attached to the second and fourth saddles 125*b* and 125*d*. The trapezoidal structure has expanded or extended in the Y direction and the translational structures 160*a* and 160*b* have allowed the trapezoidal structures to translate in response to the rotation of the first support 120.

FIG. 5 is an isometric illustration of a portion of the control inceptor system 100 shown in FIG. 3 with the first movement mechanism 102 and grip 105 in a third position. In the illustrated embodiment, the grip has been rotated about the center of rotation in the XY plane away from the first position (shown in FIG. 3) in a direction opposite of arrow P (also shown in FIG. 1), representing an aerospace vehicle nose up pitch command. Correspondingly, the first support 102 has rotated about the center of rotation and the first and second drive links 150*a* and 150*b* have moved/rotated to third positions relative to the second and fourth saddles 125*b* and 125*d*, respectively. For example, the drive links 150*a* and 150*b* have rotated in a second or clockwise direction (as viewed in FIG. 3) about the point where they are pivotally attached to the second and fourth saddles 125*b* and 125*d*. The trapezoidal structure has expanded in the Y direction (from the position shown in FIG. 3) and the translational structures 160*a* and 160*b* have allowed the trapezoidal structures to translate in response to the rotation of the first support 120.

As discussed above, the second movement mechanism 103 is configured and operates in a manner similar to the first movement mechanism 102, but is oriented orthogonally relative to the first movement mechanism 102 to allow movement or rotation of the grip 105, about a center of rotation within the operator's grasp region, in the direction of arrow R and opposite to the direction of arrow R. Accordingly, the first and second movement mechanisms 102 and 103 allow the grip 105 to be rotated in the direction of arrows P and R and opposite the direction of arrows P and R, individually or simultaneously, to provide pitch and roll inputs to the aerospace vehicle. In other embodiments, the first and second movement mechanisms 102 and 103 are not positioned orthogonally to one another and/or are positioned to provide rotation about axes with other orientations. In the illustrated embodiment, the first support 120 also serves as one of the supports for the second movement mechanisms 103. In other embodiments, the movement mechanism 102 and 103 have completely separate elements and are coupled together, for example, with a spacing element.

In selected embodiments, the control inceptor system 100 can include various sensors or sensor systems can be used to sense the position and/or movement of portions of the control inceptor system, for example, the position and/or movement of the grip. This positional or movement information can be used, for example, to supply command inputs to a system operably coupled to the control inceptor system. For example, when the control inceptor is used in a vehicle or on a crane, the position of the grip can be used to control the vehicle or operate the crane. In selected embodiments, the sensor can include a potentiometer or other type of transducer. In certain embodiments, at least one portion of the sensor or sensor system can be coupled to, or connected to, one or more elements of the control inceptor system. In other embodiments, the sensor or sensor system can be positioned proximate to selected portions of the control inceptor system.

In other embodiments, a sensing system can be used to sense the amount of force being applied by an operator to the grip and/or various portions of the control inceptor system. For example, the control inceptor system can include an urging element (e.g., a spring or bungee system) and/or a force feedback element (e.g., an actuator system) that urges the grip toward certain positions under selected conditions. Accordingly, the amount of force an operator uses to resist movement of the grip and/or to move the grip to a selected position can be sensed and used to provide control input to a related system.

In FIG. 2, a sensor 170 is shown positioned proximate to the second drive link 150*b* and is configured to detect the position and/or movement of the second drive link relative to the fourth saddle 125*d*. In the illustrated embodiment, the position of the first and second drive links 150*a* and 150*d* are a function of the position of the grip in the XY plane. Accordingly, by sensing the position of one of the drive links 150*a* or 150*b*, the position of the grip can be determined and used to provide input commands to a related system. For example, the sensor 170 (shown in FIG. 2) can provide pitch commands to an aerospace vehicle control system. A similar sensor can be used on the second movement mechanism 103 to sense the movement of the grip in the YZ plane and to provide roll commands.

A feature of at least some of the embodiments described above is that the center of rotation of operator input movements are located within the operator's grasp region. An advantage of this feature is that, in selected embodiments an operator can make control inputs under high or varying g conditions and/or in high vibration environments more precisely than with current systems. For example, in certain embodiments the center of rotation being located within the operator's grasp region can reduce the amount of compensation required by the pilot when making inputs during high or varying g conditions and/or in high vibration environments. Another feature of at least some of the embodiments described above is that the control inceptor system has all of the movement mechanisms positioned on one side of the grip. An advantage of this feature is that a control inceptor system having a center of rotation located within the operator's grasp region can be mounted so that only the grip extends away from a mounting surface and there are no other control inceptor system elements extending away from the mounting surface in the same direction as the grip to interfere with operation of and/or access to the grip.

In other embodiments, the control inceptor system can include other arrangements, including more, fewer, and/or different mechanisms, structures, members, drive links, saddles, and/or sensors. For example, in a selected embodiment a control inceptor system having first and second movement mechanisms similar to those discussed above can include a third movement mechanism that allows the grip to be rotated about an axis extending at least approximately outwardly from the grip in the direction that the grip extends away from the first and second movement mechanisms (e.g., similar to a twist grip). Accordingly, the axis of rotation would be at least approximately parallel to a line extending between the thumb and the little finger of the operators hand as the operator grasps the grip and the center of rotation can be located within the grasp region of the operator's hand.

In still other embodiments, the control inceptor system can be configured so that the center of rotation for selected input movements are within the operator's grasp region and the center of rotation for other inputs movements are not within the operator's grasp region. For example, in selected embodiments where the inceptor system is used in an aircraft, the center of rotation for pitch inputs can be within the grasp region of the operator, while the center of rotation for roll inputs is not within the grasp region of the operator. In certain embodiments, various portions of the control inceptor system can be adjusted to provide a selected range of motion and/or a selected input command for selected grip movements or grip pressures/forces. For example, in selected embodiments where the motion of the drive link is used to sense grip position, the length of the drive links can be chosen to provide a selected relationship between movements of the grip and movements of the drive links.

In certain embodiments, the size, orientation, and arrangement of various control inceptor system portions (e.g., components and/or elements) can be selected to provide a linear relationship between the movement of the grip and the output of the system. In other embodiments, the size, orientation, and arrangement of various control inceptor system portions can be selected to provide a non-linear relationship between the movement of the grip and the output of the system. For example, in selected embodiments the control inceptor system can be configured so that the drive link moves a larger amount per unit of grip movement when the grip is near its range of motion limit as compared to when the grip is near a neutral position. In other embodiments, the control inceptor system can be configured so that the drive link moves a first amount per unit of grip movement when the grip is moved in a first direction away from the neutral position and a second different amount per unit of grip movement when the grip is moved in a second direction away from the neutral position. In still other embodiments, a sensor and/or computing system can be used to vary the output from the control inceptor system based on the position of the grip and/or the force being applied to the grip.

In yet other embodiments, the drive link, translational structure, and expanding/collapsing structure arrangement of the movement mechanisms can be inverted as compared to the configuration shown in FIGS. 1-5. For example, in selected embodiments the relationship between the drive link, translational structure, and expanding/collapsing structure of the first movement mechanism shown in FIGS. 1-5 can remain the same relative to one another, but the arrangement can be positioned between the first and second supports in an inverted orientation. For example, in FIG. 2, inverted arrangement can be coupled to the first and second supports by coupling the drive links and translational structures of the inverted arrangement to the first and third saddles, and coupling the expanding/collapsing structures of the inverted arrangement to the second and fourth saddles. In still other embodiments, the control inceptor system can include a different type of grip and/or multiple grips. Additionally, in selected embodiments various portions of the control inceptor system can be made of various types of materials including metals, composites, plastics, wood, and the like.

From the foregoing, it will be appreciated that specific embodiments of the invention have been described herein for purposes of illustration, but that various modifications may be made without deviating from the invention. For example, aspects of the invention described in the context of particular embodiments may be combined or eliminated in other embodiments. Although advantages associated with certain embodiments of the invention have been described in the context of those embodiments, other embodiments may also exhibit such advantages. Additionally, not all embodiments need necessarily exhibit such advantages to fall within the scope of the invention. Accordingly, the invention is not limited except as by the appended claims.

We claim:

1. A control inceptor system for use by an operator having a hand with a grip region, comprising:

a grip configured to be grasped by the operator's hand wherein the grip is located within the grip region of the hand;

a first movement mechanism coupled to and exterior of the grip, the first movement mechanism having a collapsible first linkage arrangement, and at least a portion of the first movement mechanism being rotatable with the grip in a first plane about a first center of rotation that is positioned within the grip region when the operator is grasping the grip; and a second movement mechanism coupled to and exterior of the grip, the second movement mechanism having a collapsible second linkage arrangement, and at least a portion of the second movement mechanism being rotatable with the grip in a second plane about a second center of rotation that is positioned within the grip region when the operator is grasping the grip, wherein the second plane is angularly offset from the first plane;

wherein the grip is connected to the first movement mechanism, and wherein the first movement mechanism is connected to the second movement mechanism intermediate the grip and the second movement mechanism.

2. The control inceptor system of claim 1 wherein the first plane is orthogonal to the second plane.

3. The control inceptor system of claim 1 wherein first center of rotation is substantially collocated with the second center of rotation.

4. The control inceptor system of claim 1 wherein the first movement mechanism and the grip are rotatable as a unit about an axis substantially parallel to a line extending between a back of the operator's hand and a palm of the hand as the operator grasps the grip.

5. The control inceptor system of claim 1 wherein the grip and the first movement mechanism are rotatable in the first plane about the first center of rotation in response to an input movement from the operator's hand.

6. The control inceptor system of claim 1 wherein the grip and the first movement mechanism are rotatable in the first plane about the first center of rotation simultaneous with rotation of the grip and the second movement mechanism in the second plane about the second center of rotation.

7. The control inceptor system of claim 1 wherein the first movement mechanism and the grip are moveable as a unit in the second plane about the second center of rotation when the second movement is rotated in the second plane.

8. The control inceptor system of claim 1 wherein the first movement mechanism has a first support member connected to the grip, the first linkage arrangement connected to the first support member with the first support member intermediate the grip and the first linkage arrangement, and a second support member connected to the first linkage arrangement with the first linkage arrangement intermediate the first and second support members, and wherein a portion of the first linkage arrangement is movable relative to the second support member so the first support member and the grip move in an arc in the first plane about the first center of rotation.

9. The control inceptor system of claim 8 wherein the first linkage arrangement includes first and second collapsible assemblies coupled to the first support member and being moveable between collapsed and expanded positions, wherein the first collapsible assembly moves toward the collapsed position and the second collapsible assembly moves toward the expanded position when the first support plate and the grip rotate in the first plane in a first direction, and the first collapsible assembly moves toward the expanded position and the second collapsible assembly moves toward the collapsed position when the first support member and the grip rotate in the first plane in a second direction opposite the first direction.

10. The control inceptor system of claim 8 wherein the second movement mechanism has a third support member connectable to a mounting structure, the second linkage arrangement connected to the third support member and the second support member, wherein the second linkage arrangement is intermediate the second and third support members, and wherein the second linkage arrangement being movable relative to the third support member so the second first support member and the grip move in an arc in the second plane about the second center of rotation.

11. The control inceptor system of claim 8 wherein the second linkage arrangement includes third and fourth collapsible assemblies coupled to the first support member and being moveable between collapsed and expanded positions, wherein the third collapsible assembly moves toward the collapsed position and the fourth collapsible assembly moves toward the expanded position when the second support plate and the grip rotate in the second plane in a first direction, and the third collapsible assembly moves toward the expanded position and the fourth collapsible assembly moves toward the collapsed position when the second support plate and the grip rotate in the second plane in a second direction opposite the first direction.

12. The control inceptor system of claim 1 further comprising a first movement sensor coupled to the first movement mechanism and configured to detect rotational movement of the first movement mechanism in the first plane, and a second movement sensor coupled to the second movement mechanism and configured to detect rotational movement of the second movement mechanism in the second plane.

13. The control inceptor system of claim 1 further comprising a vehicle control system, and the wherein the grip, the first movement mechanism, and the second movement mechanism are coupled to the vehicle control system.

14. A control inceptor system for use by an operator having a hand with a grip region, comprising:

a grip configured to be grasped by the operator's hand so the grip is within the grip region, wherein the grip is moveable in a three-dimensional X-Y-Z frame of reference defined by an XY plane, a YZ plane and a ZX plane all orthogonal to each other;

a first movement mechanism coupled to the grip, at least a portion of the first movement mechanism being rotatable with the grip in the XY plane about a first center of rotation that is positioned within the grip region when the operator is applying a first input force to the grip substantially parallel to the XY plane, the first movement mechanism having a first linkage arrangement movable between collapsed and expanded positions upon movement of the grip; and a second movement mechanism coupled to the grip, as least a portion of the second movement being rotatable with the grip in the YZ plane about a second center of rotation that is positioned within the grip region when the operator is applying a second input force to the grip substantially parallel to the YZ plane, the second movement mechanism having a second linkage arrangement movable between collapsed and expanded positions upon movement of the grip;

wherein grip is connected to the first movement mechanism, and the first movement mechanism is connected to the second movement mechanism intermediate the grip and the second movement mechanism.

15. The control inceptor system of claim 14 wherein first center of rotation is substantially collocated with the second center of rotation.

16. The control inceptor system of claim 14 wherein the portion of the first movement mechanism and the grip are rotatable as a unit in the YZ plane without rotating in the XY plane.

17. The control inceptor system of claim 14 wherein the grip and the portion of the first movement mechanism are rotatable in the XY plane about the first center of rotation simultaneous with rotation of the grip and the portion of the second movement mechanism in the YZ plane about the second center of rotation.

18. The control inceptor system of claim 14 wherein the first movement mechanism has a first support member connected to the grip, the first linkage arrangement connected to the first support member with the first support member intermediate the grip and the first linkage arrangement, and a second support member connected to the first linkage arrangement with the first linkage arrangement intermediate the first and second support members, and wherein the first support member and at least a portion of the first linkage arrangement being movable relative to the second support member so the first support member and the grip move in an arc in the XY plane about the first center of rotation.

19. The control inceptor system of claim 18 wherein the first linkage arrangement includes first and second collapsible assemblies coupled to the first support member and being moveable between collapsed and expanded positions, wherein the first collapsible assembly moves toward the collapsed position and the second collapsible assembly moves toward the expanded position when the first support plate and the grip rotate in the XY plane in a first direction, and the first collapsible assembly moves toward the expanded position and the second collapsible assembly toward the collapsed position when the first support member and the grip rotate in the XY plane in a second direction opposite the first direction.

20. The control inceptor system of claim 18 wherein the second movement mechanism has a third support member connectable to a mounting structure, the second linkage arrangement connected to the third support member and the second support member, wherein the second linkage arrangement is intermediate the second and third support members, and wherein the second linkage arrangement being movable relative to the third support member so the second first support member and the grip move in an arc in the YZ plane about the second center of rotation.

21. The control inceptor system of claim 18 wherein the second linkage arrangement includes third and fourth collapsible assemblies coupled to the first support member and being moveable between collapsed and expanded positions, wherein the third collapsible assemblies moves toward the collapsed position and the fourth collapsible structure moves toward the expanded position when the second support plate and the grip rotate in the YZ plane in a first direction, and the third collapsible assembly moves toward the expanded position and the fourth collapsible assembly moves toward the collapsed position when the second support plate and the grip rotate in the YZ plane in a second direction opposite the first direction.

22. The control inceptor system of claim 14 further comprising a movement sensor coupled to at least one of the first and second first movement mechanisms and configured to detect rotational movement of the one of the first and second movement mechanism in the respective XY and YZ planes.

23. The control inceptor system of claim 14 further comprising a vehicle control system, and wherein the grip, the first movement mechanism and the second movement mechanism are coupled to the vehicle control system.

24. A control system for a vehicle operated by an operator having a hand with a grip region when the operator grasps a portion of the control system, comprising:

a control devices moveable to provide control of at least a portion of the vehicle;

a control area configured to receive the operator therein;

a control inceptor system mounted in the control area and coupled to the control devices, the control inceptor system having:

a grip configured to be grasped by the operator's hand and located within the grip region;

a first movement mechanism coupled to and exterior of the grip, the first movement mechanism having a collapsible first linkage arrangement and at least a portion of the first movement mechanism being rotatable with the grip in a first plane about a first center of rotation that is positioned within the grip region when the operator is grasping the grip; and a second movement mechanism coupled to and exterior of the grip, the second movement mechanism having a collapsible second linkage arrangement and at least a portion of the second movement mechanism being rotatable with the grip in a second plane about a second center of rotation that is positioned within the grip region when the operator is grasping the grip, wherein the second plane is angularly offset from the first plane;

wherein the grip is connected to the first movement mechanism, and wherein the first movement mechanism is connected to the second movement mechanism intermediate the grip and the second movement mechanism.

25. The control system of claim 24 wherein the vehicle is one of an aircraft, space craft, and watercraft, and the control devices include at least one control surface for controlling movement of the vehicle.

26. The control system of claim 24 wherein first center of rotation is substantially collocated with the second center of rotation.

27. The control system of claim 24 wherein the first movement mechanism and the grip are rotatable as a unit about an axis substantially parallel to a line extending between a back of the operator's hand and a palm of the hand as the operator grasps the grip.

28. The control system of claim 24 wherein the first and second centers of rotation are located at a position within the grip or substantially adjacent to a surface of the grip.

29. The control system of claim 24 wherein the grip and the first movement mechanism are rotatable in the first plane about the first center of rotation simultaneously with rotation of the grip and the second movement mechanism in the second plane about the second center of rotation.

30. The control system of claim 24 wherein the first movement mechanism and the grip are moveable as a unit about the second center of rotation when the second movement is rotated in the second plane without the grip and the first movement mechanism rotating in the first plane.

31. A method of operating a vehicle by an operator for movement of at least a portion of the vehicle, comprising:

grasping with the operator's hand a grip of a control inceptor system, the control inceptor system comprising the grip configured to be grasped by the operator's hand so the grip is within the grip region of the hand, a first movement mechanism coupled to and exterior of the grip, the first movement mechanism having a collapsible first linkage arrangement and at least a portion of the first movement mechanism being rotatable with the grip in a first plane about a first center of rotation that is positioned within the grip region when the operator is grasping the grip, and a second movement mechanism coupled to and exterior of the grip, the second movement mechanism having a collapsible second linkage arrangement and at least a portion of the second movement mechanism being rotatable with the grip in a second plane about a second center of rotation that is positioned within the grip region when the operator is grasping the grip, wherein the second plane is angularly offset from the first plane, wherein the grip is connected to the first movement mechanism, and wherein the first movement mechanism is connected to the second movement mechanism intermediate the grip and the second movement mechanism;

applying a first input force to the grip and rotating the grip and at least a portion of the first movement mechanism to rotate in the first plane about the first center of rotation;

moving a first portion of the vehicle in response to the first input force and rotation of the grip in the first plane about the first center of rotation;

applying a second input force to the grip and rotating the grip and at least a portion of the second movement mechanism to rotate in the second plane about the second center of rotation; and moving a second portion of the vehicle in response to the second input force and rotation of the grip in the second plane about the second center of rotation.

32. The method of claim 31 wherein the first and second input forces are applied at lease one of simultaneously and sequentially, and the grip and the portion of the first movement mechanism rotate about the first center of rotation simultaneously or sequentially with rotation of the grip and the portion of the second movement mechanism about the second center of rotation.

33. The method of claim 31 wherein the grip and the first movement mechanism move as a unit in the second plane when the grip and the portion of the second movement mechanism rotate in the second plane about the second center of rotation.

* * * * *

UNITED STATES PATENT AND TRADEMARK OFFICE

CERTIFICATE OF CORRECTION

PATENT NO. : 8,100,029 B2
APPLICATION NO. : 12/029435
DATED : January 24, 2012
INVENTOR(S) : Peterson et al.

It is certified that error appears in the above-identified patent and that said Letters Patent is hereby corrected as shown below:

On Page 5, in Column 5, at line 3, delete “invention,” and insert -- invention. --, therefor.

On Page 12, in Claim 13 in Column 12, at line 40, after “and” delete “the”.

On Page 14, in Claim 32 in Column 16, at line 12, delete “at lease” and insert -- at least --, therefor.

Signed and Sealed this
Twenty-ninth Day of May, 2012

David J. Kappos

David J. Kappos
*Director of the United States Patent and Trademark Office*